US005692445A

United States Patent [19]

Winer

[11] Patent Number: 5,692,445

[45] Date of Patent: Dec. 2, 1997

[54] MULTIPLE CONFIGURATION FOLDING TABLE

[76] Inventor: Robert D. Winer, 13120 Laurel Glen Rd., Clifton, Va. 20124

[21] Appl. No.: 686,715

[22] Filed: Jul. 26, 1996

[51] Int. Cl.[6] ..... A47B 57/00

[52] U.S. Cl. ..... 108/100; 108/101

[58] Field of Search ..... 108/99, 100, 101, 108/64

[56] References Cited

U.S. PATENT DOCUMENTS

| | | | |
|---|---|---|---|
| 1,013,032 | 12/1911 | Lund . | |
| 1,287,444 | 12/1918 | Rudy . | |
| 1,514,055 | 11/1924 | Lawson | 108/100 |
| 2,129,396 | 9/1938 | Archer . | |
| 2,209,690 | 7/1940 | Fraser . | |
| 2,542,394 | 2/1951 | Cohen et al. . | |
| 2,643,926 | 6/1953 | Pucci . | |
| 2,743,978 | 5/1956 | Shore . | |
| 2,747,956 | 5/1956 | Leichter . | |
| 2,868,599 | 1/1959 | Roggio . | |
| 2,903,313 | 9/1959 | Block . | |
| 3,362,358 | 1/1968 | Farish, III . | |
| 3,429,081 | 2/1969 | Robinson et al. . | |
| 3,564,790 | 2/1971 | Rehfeld . | |
| 4,841,877 | 6/1989 | Virtue . | |
| 4,927,128 | 5/1990 | O'Brian . | |
| 5,357,876 | 10/1994 | Kniefel et al. . | |
| 5,381,873 | 1/1995 | Kniefel et al. . | |

*Primary Examiner*—Peter M. Cuomo
*Assistant Examiner*—Gerald A. Anderson
*Attorney, Agent, or Firm*—Nixon & Vanderhye

[57] ABSTRACT

The table includes a plurality of generally planar panels pivotally secured to one another along opposite edges and in series with one another to define a plurality of spaced generally parallel pivotal axes. A number of the panels form step panels having legs disposable in stored and table supporting positions. The legs in the stored position lie within the panels and extend at right angles into the support positions. Panels intermediate the step panels form riser panels. The panels are pivotal relative to one another between positions wherein the panels lie in generally parallel planes forming a compact portable unit and lie in a stepped arrangement with the riser panels extending vertically between step panels lying at different elevations relative to one another to form a folding table capable of being erected in a variety of multi-tiered and co-planar configurations.

10 Claims, 9 Drawing Sheets

MULTIPLE CONFIGURATION FOLDING TABLE

TECHNICAL FIELD

The present invention relates generally to tables and more particularly to folding tables that can be erected in a variety of multi-tiered and/or coplanar well supported configurations and folded to a compact storage configuration which is light in weight and readily and easily portable.

BACKGROUND

Many types and configurations of tables have been proposed and constructed in the past. Typically, portable tables have a planar surface and legs pivotally mounted along their undersides for extension into a table-supporting position and folding into a table-storage position. Tables have also been proposed and constructed in several connected sections whereby the assembly of these sections provides an elongated, generally planar horizontal surface. These latter tables, however, are generally unwieldy, are incapable of being folded into a truly compact portable unit which can be carried by an individual and provide only a single horizontal surface for use as a work or display area. There are, however, many instances in which it is desirable to provide a multi-tiered table in various configurations for the display of objects such as curios, jewelry, brochures and the like. Additionally, it is desirable for such a multi-configured table to be folded into a compact, lightweight, easily portable unit so that an individual can transport the table between various locations and have the ability to readily and easily set up and knock down the table at each location.

DISCLOSURE OF THE INVENTION

The present invention meets these objectives and provides a table which can be arranged in a multiplicity of configurations, for example, a multi-tiered or step-type configuration, a flat planar configuration, or various combinations of tiered and extended horizontal surfaces. To accomplish this, the table of the present invention includes a plurality of panels, preferably rectilinear in configuration, which are pivotally connected one to the other in series along their long edges or margins. In a preferred form of the present invention, every other panel of the series of pivotally connected panels, for example, the first, third and fifth panels of a five-panel table, has a plurality of legs carried along the undersurface of each such panel and marginal depending flanges. Preferably, the legs are pivoted to the panels along the inside surface of the depending flanges of the panels between a folded or stored position within the peripheral confines of the panel and a table-supporting position extending generally vertically at right angles to the panel for supporting the panel and associated portions of the table. Thus, the panels mounting the legs may form a series of horizontal surfaces at different elevations or tiers, with each panel having a different length of legs. The panels between the step-forming panels form vertical risers connecting adjacent tiered steps. An initial panel may be provided and pivotally connected to the first panel to form a riser panel between the first step panel and ground level as desirable. It will be appreciated that while the legs are preferably pivotally mounted to the panels forming the steps, they alternately can be separate from the step-forming panels and releasably secured, for example, by clips to the undersurface of the step-forming panels for insertion into leg mountings provided along the undersurface of such panels. The legs may also be provided in telescopic form, either pivotally or detachably secured to the underside of the panels, so that the different elevations of the step-forming panels can be accommodated.

In this basic and preferred configuration of the present multi-configured table, it will be appreciated that the panels are pivotally interconnected one with the other such that, with the legs folded into or attached to the panel in the stored position along the underside of each step-forming panel, the panels can be alternately reverse-folded upon one another so that the panels overlie one another to lie in generally parallel planes, e.g., stacked on top of one another or folded into side-by-side relation, forming a compact, readily portable unit. By using suitable catches interconnecting the panels to one another when knocked down into stacked or folded positions and providing a suitable handle or handles on one or more of the panels, a compact, easily portable folding table is provided. Unfolding the table from its compact configuration is accomplished by reversing the folding procedure and extending the legs from the panels.

In a further form of the present invention, the panels forming the risers between the step-forming panels may also have legs pivotally mounted or detachably secured to the undersides thereof for disposition between stored and panel-support positions. By providing legs for the riser panels, they may also form horizontal table surfaces when pivoted to lie in a common plane with the step-forming panels. Thus, the legs of the riser panels, when forming step-forming panels, may be deployed to support the riser panel in a horizontal configuration whereby two or more adjacent panels may form an elongated horizontal surface corresponding in length to the combined width of two or more panels. By providing a substantial number of panels (in excess of or fewer than the six panels illustrated), it will be appreciated that a multi-tiered table with extended horizontal surfaces may be provided in various combinations to form variously configured tables. Because of the necessity to reversely fold each panel onto an adjacent panel to form the compact portable unit, the use of riser panels as horizontal surfaces provides a discontinuity in the horizontal surface formed with an adjacent step panel. To eliminate this discontinuity, panel inserts may be employed to overlie the riser panels when deployed in their horizontal configuration to provide a smooth continuous horizontal surface with the adjacent step panel. In some configurations, these inserts may be provided to form smooth continuous vertical surfaces, or both It will be appreciated that the multiple configuration table of the present invention can be readily folded into a compact portable unit and unfolded upon setup into a multi-tiered configuration. For example, to fold the table from its multi-tiered configuration into a portable unit, the legs of the step panel at the highest elevation may be first removed and attached to or folded for storage along the underside of that step panel. By swinging the step panel about its pivotal axis with the adjoining riser panel and swinging the adjoining riser panel about its pivotal axis with the next-lower step panel, the step panel and riser panel can be folded onto the next lower step panel to overlie one another and the next lower step panel in generally parallel planes. By continuing this process, alternately reverse-folding the panels, all step and riser panels can be folded to overlie one another such that the panels lie in a common plane contiguous to one another forming a compact unit. It will be appreciated that by swinging the initial step panel about its pivotal axis with the adjoining riser, an enclosed compartment is formed for housing the legs and braces. Additional compartments are formed for like purposes by folding the remaining step and riser panels onto one another. Further, by forming the table of lightweight materials such as aluminum, the table, when folded, forms a compact, lightweight portable unit. The unit can be unfolded, i.e., set up into the multi-tiered table configuration, by reversing the process, preferably commencing with the riser and step panels which form the lowest tier or elevation of the multi-tiered table.

A number of novel features are incorporated into the multi-configuration table of the present invention. First, the table is composed of multiply connected panels that can be easily manipulated to provide many varied table configurations, i.e., multi-tiered, expanded horizontal surfaces or combinations thereof. Secondly, it utilizes multiple pairs of legs to firmly support each of those surfaces. Third, it provides support legs at the ends of each panel which, in the case of pivotally mounted support legs, are pivotal about axes generally normal to the pivotal axes of the adjoining panels. Fourth, the table folds into a compact, consolidated unit that can be unfolded into a table with a relatively large surface area. Fifth, the table can be readily knocked down into a portable, lightweight compact unit facilitating its transport between various locations.

In a preferred embodiment according to the present invention, there is provided a multi-tiered folding table, comprising a first generally planar panel, a second planar panel pivotally secured along one side thereof to a side of the first panel for pivotal movement about a first axis in one direction between a first position extending generally normal to the first panel and a second folded position lying in a plane generally parallel to a plane containing the first panel, a third planar panel pivotally secured along one side thereof to a side of the second panel opposite to and remote from the first panel for pivotal movement about a second axis generally parallel to the first axis and in a direction opposite the one direction between a first position extending generally normal to the second panel and a second folded position lying in a plane generally parallel to a plane containing the second panel, the first panel having legs disposable in stored and supporting positions, the legs in the stored position extending generally parallel to the first panel and in the first panel supporting position extending from the first panel for supporting the first panel in a generally horizontal plane at a first elevation, the third panel having legs disposed in stored and supporting positions, the legs of the third panel in the stored position extending generally parallel to the third panel and in the third panel supporting position extending from the third panel for supporting the third panel in a generally horizontal plane at a second elevation different from the first elevation, the second panel in its preferred position, when the legs of the first and third panels lie in the first and third panel supporting positions, extending between and lying generally perpendicular to the first and third panels, the second and third panels being pivotal about the first and second axes, respectively, such that the first, second and third panels lie in generally parallel planes to form a compact portable folded multi-tiered table.

In a further preferred embodiment according to the present invention, there is provided a multi-tiered folding table comprising a plurality of generally planar panels pivotally secured to one another along opposite edges and in series with one another to define a plurality of spaced, generally parallel pivotal axes, at least two of the panels having legs disposable in stored and supporting positions, respective legs of the two panels in the stored position extending generally parallel to the panels in their stored position and in the supporting position extending therefrom for supporting the panels in generally horizontal planes, the legs of the two panels being different in length to support the two panels at different elevations relative to one another, at least an intermediate panel of the plurality thereof being disposed between at least two panels and extending generally normal to the two panels, the two panels with the legs in the stored position and the intermediate panel being pivotal about the axes, respectively, such that at least two panels and the intermediate panel lie in planes generally parallel to one another forming a compact portable folded multi-tiered table.

Accordingly, it is a primary object of the present invention to provide a multi-configuration folding table that can be erected in a multiplicity of multi-tiered and/or coplanar configurations and various combinations thereof which is well supported and which can be folded into a compact, lightweight unit for easy transportation between different locations.

BEST MODE FOR CARRYING OUT THE INVENTION

Figure 1:
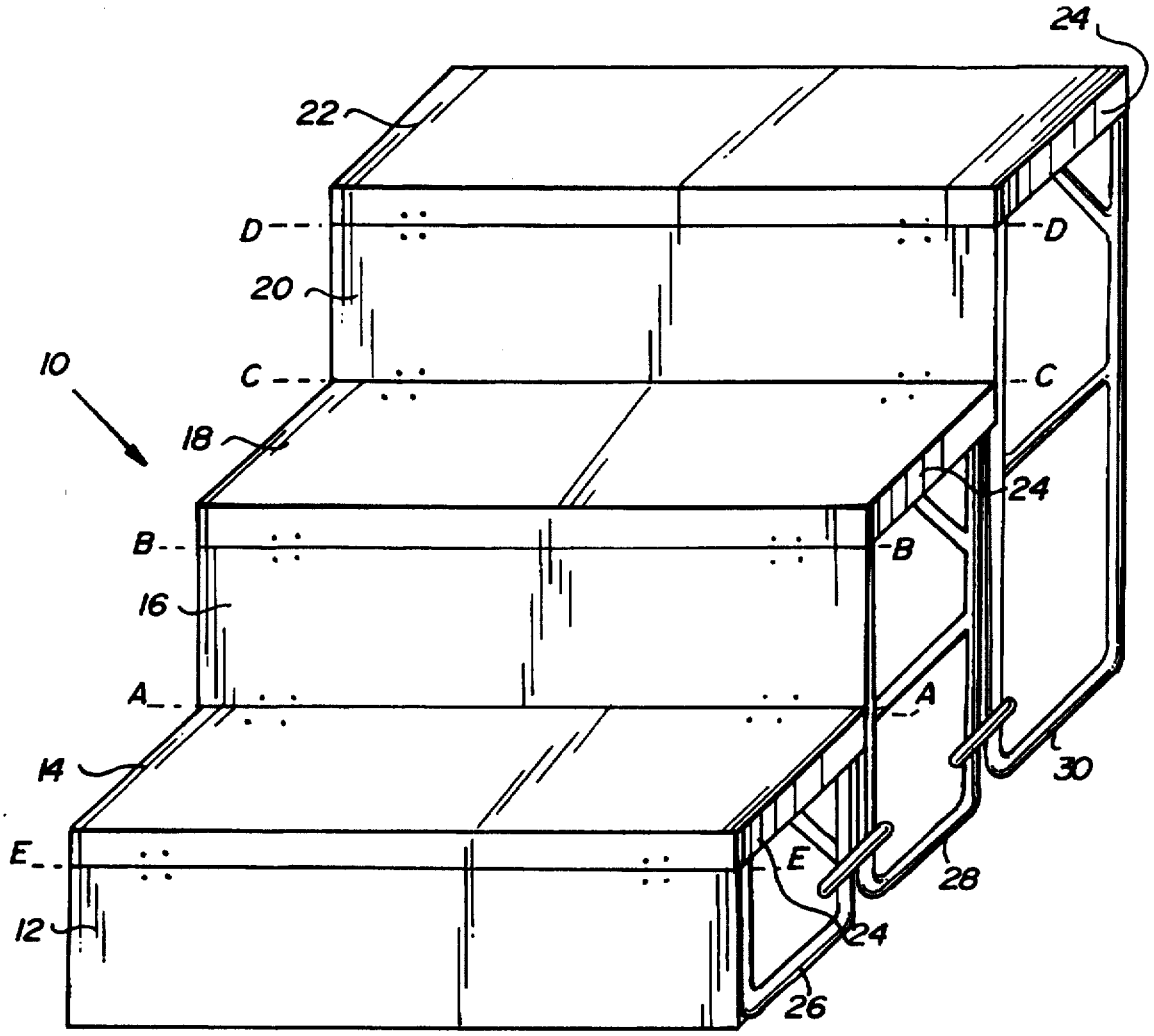
FIG. 1 is a perspective view of a multiple configuration folding table according to the present invention illustrating a preferred form of multi-tiered table.

Referring now to the drawings, particularly to FIG. 1, there is illustrated a multi-configuration table constructed in accordance with the present invention and generally designated 10. Table 10 includes a plurality of panels, for example, panels 12, 14, 16, 18, 20 and 22, arranged in a stair-step or multi-tiered configuration as illustrated. For example, panels 14, 18 and 22 lie in generally horizontal planes at different elevations relative to one another and panels extending horizontally are generally referred to herein for convenience as step panels, e.g., step panels 14, 18 and 22. In this multi-tiered configuration, the panels 12, 16 and 20 extend generally vertically relative to the step panels and panels arranged in a vertical configuration are herein referred to for convenience as riser panels, e.g., riser panels 12, 16 and 20. It will be appreciated from a review of FIG. 1 that the riser and step panels alternate one with the other to provide the illustrated multi-tiered table configuration and that, as clear from the ensuing description, the table may be configured such that the various panels may comprise either step or riser panels. Further, while six panels are illustrated and described herein, fewer or more panels may be provided within the scope of the present invention and arranged similarly as the sequence of panels described and illustrated.

Figure 4:
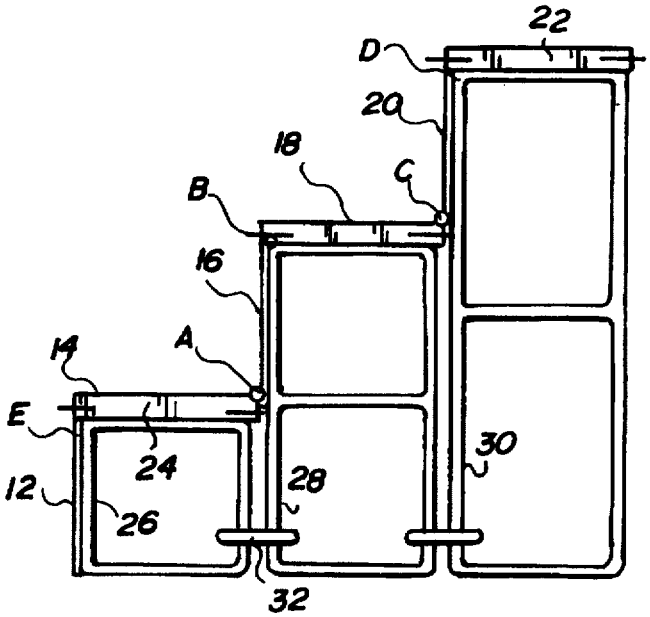
FIG. 4 is a side elevational view of a preferred embodiment of the table hereof illustrating the hinge axes.

As will also be appreciated from the ensuing description, the panels are sequentially pivotally coupled to one another, preferably along the adjoining margins or edges of the adjacent panels. Thus, as illustrated in FIGS. 1 and 4, a first step panel 14 is pivotally secured to an adjoining riser panel 16 by suitable hinges which define an axis of rotation A—A between step panel 14 and riser panel 16. Riser panel 16 and step panel 18 are pivotally secured one to the other by hinges pivoted about a second hinge axis, designated B—B. Step panel 18 and riser panel 20 are pivotally secured one to the other by hinges defining a third pivotal axis C—C. Riser panel 20 and step panel 22 are pivotally secured one to the other by hinges defining a fourth pivotal axis D—D. Where an initial riser panel 12 is used, it is pivotally secured by suitable hinges to the first step panel 14 by hinges defining an additional axis E—E. It will be appreciated that the panels are preferably rectilinear with the various hinges disposed along the long side of the panels whereby the axes of rotation lie parallel to the longitudinal extent of each of the panels.

Figure 2:
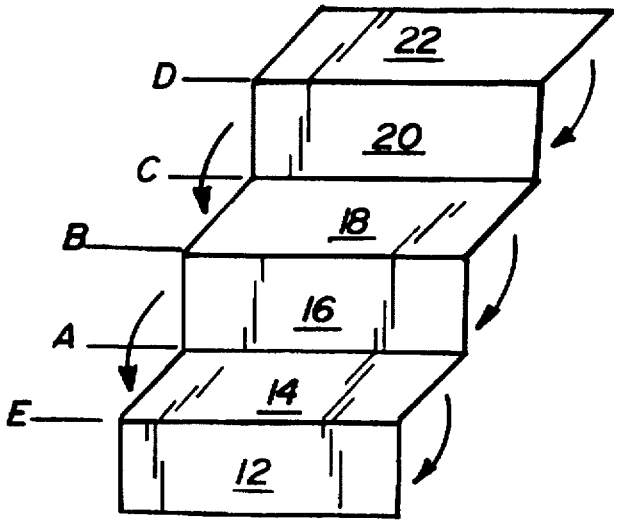
FIG. 2 is a schematic illustration of a preferred manner of folding various panels of the table hereof into the compact unit illustrated in FIG. 3.
Figure 3:
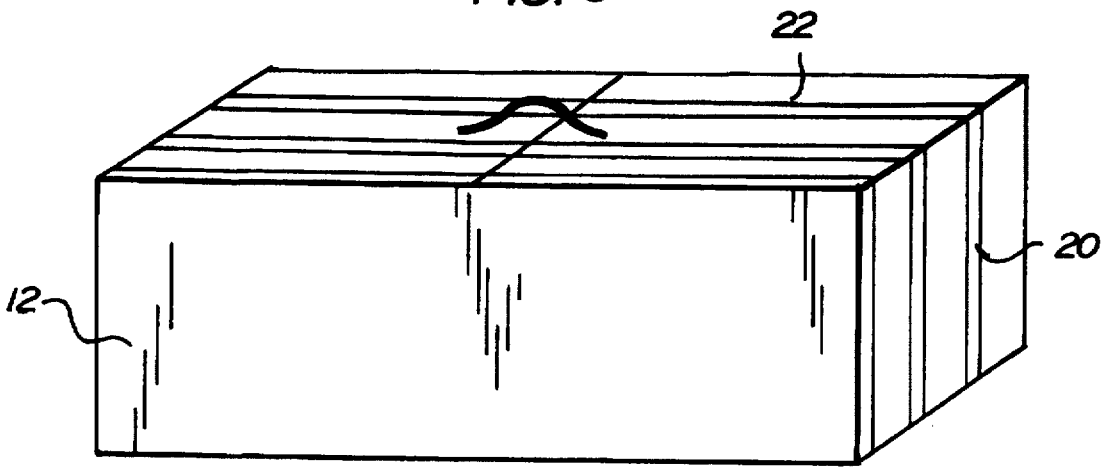
FIG. 3 is a perspective view of the table of FIG. 1 folded into the compact portable unit.

As schematically illustrated in FIGS. 2 and 3, the panels are folded alternately in opposite or reverse directions such that the panels may overlie one another in generally parallel planes to form a stacked or side-by-side arrangement. For example, riser panel 16 may be folded about axis A—A in one direction to overlie panel 14, while panel 18 is pivotal about axis B—B in an opposite direction to overlie panel 16. Panel 20 is pivotal in the one direction about axis C-C to overlie panel 18 in parallel relation therewith. Panel 22 is pivotal in the opposite direction about axis D—D to overlie panel 20. Essentially, the manner of folding is preferably an accordion-type fold with the panels alternately folding about the axes in opposite directions. The result of folding the panels as illustrated in FIG. 2 is a compact unit as illustrated in FIG. 3. By providing a handle on one or more of the panels, it will be appreciated that the table in the folded configuration is easily transportable as a compact portable unit.

Figure 5:
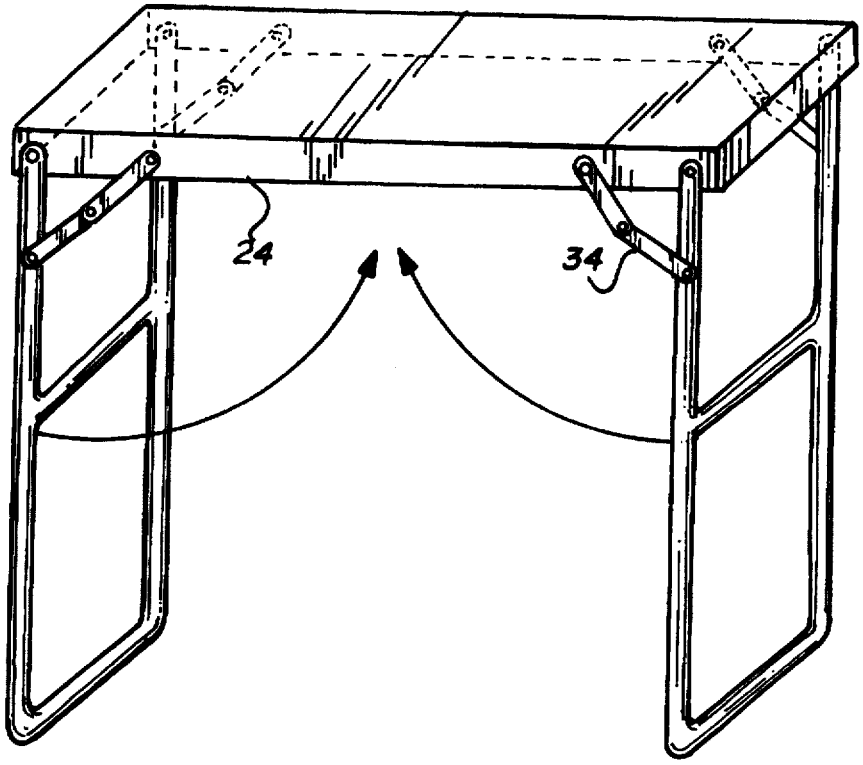
FIG. 5 is a perspective view of a panel with its legs unfolded into a panel-supporting position with friction lock support braces.

Referring to FIGS. 1, 4 and 5, and in a preferred embodiment, the panels forming steps, e.g., panels 14, 18 and 22, have a plurality of legs for supporting the panel in the different elevated positions as illustrated in FIG. 1. Each of the step panels 14, 18 and 22 has a depth dimension formed by depending flanges 24 disposed along the margins of the panels for housing legs 26, 28 and 30 in a stored position. Preferably, each of the legs at the opposite ends of each panel has a generally U-shaped configuration with ends pivoted to the panel along its underside between positions stored within the peripheral confines of the panel and an extended position supporting the panel, as illustrated in FIGS. 1, 4 and 5. It will be appreciated that the pivotal axes of the legs extend longitudinally of the tiered table, i.e., extends normal to the direction of the axes A—A, B—B, C—C, D—D and E—E and parallel to the long dimension of the rectilinear panels. Also, legs of types other than U-shaped may be provided. For example, individual legs may be provided at the four corners of the rectilinear panels, the legs being preferably tubular.

Figure 6:
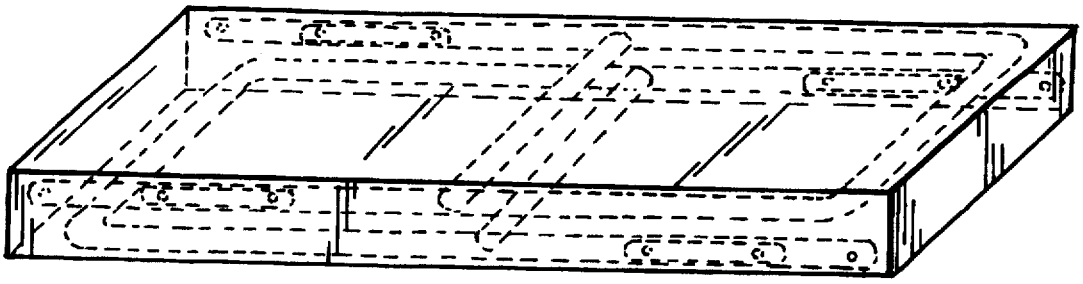
FIG. 6 is a perspective view illustrating the underside of a panel and the legs in a folded or stored configuration.

From a review of FIG. 4, it will be appreciated that the lengths of the legs 26, 28 and 30 are different, depending upon the elevation of the panel from which the legs extend in the supporting position. For the higher elevations of step panels, the legs may be adjustable in length, e.g., telescopic, or may nest one on top of one another or lie side-by-side to enable the legs to fold within the peripheral confines of the associated step panel while providing their needed length. Alternatively, the legs may be releasably secured to the underside of the step panels within the peripheral confines thereof, for example, by clips (not shown) or the like. Thus, when the table is to be set up in a multi-tiered arrangement, the individual legs may be unclipped from the step panels and inserted into mounting cups or holes formed along the underside of the table to extend in the vertical direction supporting the step panel. Such mounting cups may be utilized to house leg supporting riser panels rotated to form horizontal step panels in various table configurations. As illustrated in FIG. 4, various types of clips or ties 32 may be provided to secure the legs of the adjoining step panels one to the other for greater stability. The legs, as indicated, may be U-shaped and tubular in construction and, in the preferred embodiment where the legs are pivotally secured to the step panels, may have conventional friction lock folding braces 34 (FIG. 5) connecting the legs to an adjacent interior margin of the step panel to provide strength and stability to the table when locked in place. Thus, the legs may be folded together with their braces within the confines of the step panels as illustrated in FIG. 6. In FIG. 6, the individual legs overlie one another. Alternatively, the legs could nest within one another rather than one on top of the other as in FIG. 6.

Figure 8:
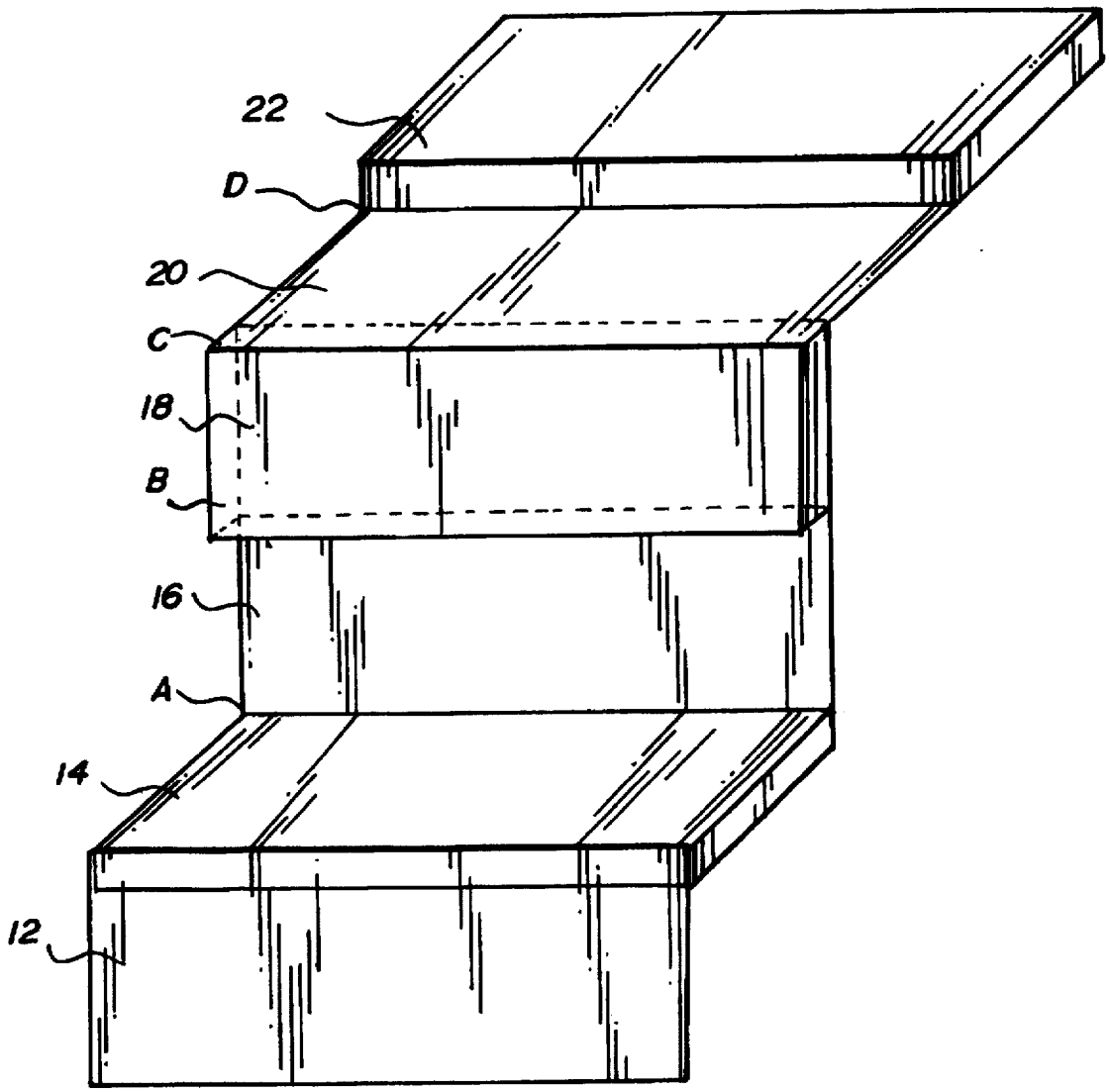
FIGS. 8–12 illustrate various configurations of the table.

While the basic and preferred configuration of the multiple configuration folding table of the present invention is illustrated in FIG. 1, it will be appreciated that variations in the width and length of the panels may be provided. Additionally, a substantial number of variations in both table height and extent of the horizontal surface of the table can be provided. For example, in FIGS. 8–12, a number of variations of the basic configuration of the table shown in FIG. 1 are illustrated. In FIG. 8, the initial three panels 12, 14 and 16 are arranged similarly as in FIG. 1. Panel 18, however, lies in coplanar relation with riser panel 16 and panel 18 therefore forms an additional riser panel. Panel 20 has been reversely-folded to form an angle of 270° with panel 18 and to form a horizontal surface, i.e., a step panel. Panel 22 lies in a plane generally parallel to the plane of panel 20. Thus, essentially only two horizontal surfaces, i.e., the surfaces formed by panel 14 and the horizontal panels 20 and 22, are provided in the configuration of FIG. 8, the panels being interchanged between step and riser panels. The table configuration of FIG. 8 is thus supported by the legs of panels 14, 20 and 22 with the legs of panel 18 remaining folded in their stored position.

Figure 7:
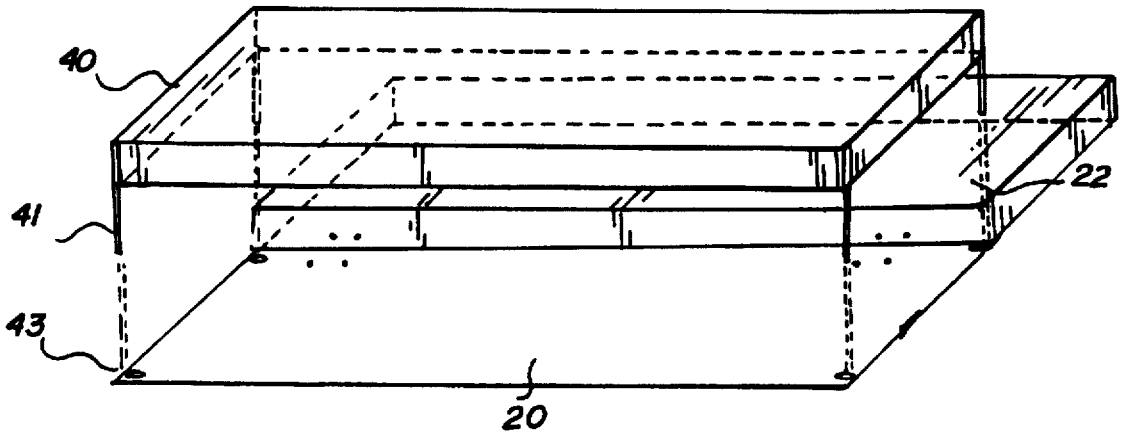
FIG. 7 is a perspective view of a panel having an insert.

It will be appreciated from a review of FIG. 8 that the alternating step panels 14, 18 and 22 have a depth dimension sufficient to house the legs of the table in a stored or folded condition. Because of this depth dimension, the use of a riser panel, for example, panel 20 as a horizontal table surface causes the upper surface of the riser, now step panel 20, to be recessed slightly below the adjoining horizontal surface of panel 22. Where necessary or desirable, an insert panel (FIG. 7) can be deployed to overlie the step panel 20 such that the upper surfaces of the insert panel and step panel 22 lie in a common plane, i.e., flush with one another. The insert panel 40 illustrated in FIG. 7 comprises a rectilinear panel having a depth dimension corresponding to the depth of the step panel 22. The insert panel 40 may be suitably secured to the riser, now step panel 30 by use of pins 41 at the corners of the panel receivable in openings 43 formed in the riser/ step panel. Any other type of alternate securement between an insert panel and a riser/step panel can be provided. A similar insert panel may be disposed to overlie the panel 16 such that the riser panels 16 and 18 may form a continuous vertical or flush surface one with the other.

Figure 9:
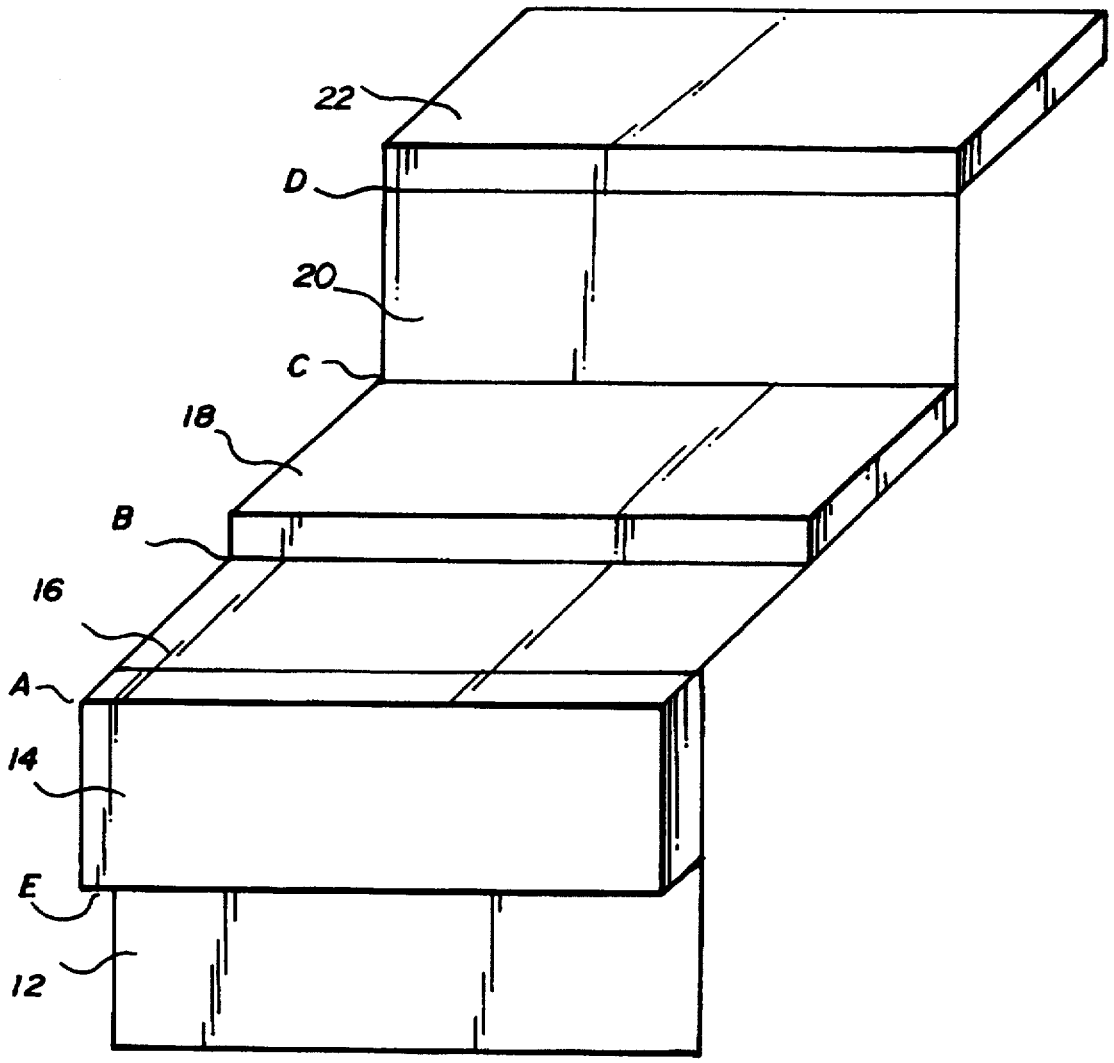

In FIG. 9, panel 14 lies essentially coplanar with panel 12, while panel 16 has been reverse-folded to form a 270° angle with panel 14 and form a step panel. Panel 18 thus forms a continuation of the horizontal surface of panel 16, the panels 18, 20 and 22 remaining as illustrated in FIG. 4. The selectively detachable and attachable legs, similar to those described and illustrated previously with respect to the step panels, e.g., panel 14, may be used with panel 16 to provide support. Thus, where riser panels are used as step panels, separate legs are provided as previously described for detachable securement to mounts on the underside of these panels and may be stored along the underside of the step panels by suitable brackets or clips or carried as separate attachments. Insert panels 40 may be used to overlie the one or both of the panels 16 and 12 so that continuous flush surfaces with the adjacent panels may be formed. The legs of panels 16, 18 and 22 support the table in this configuration.

Figure 10:
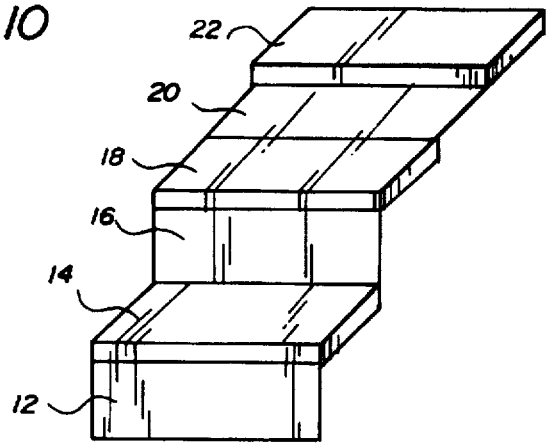
Figure 11:
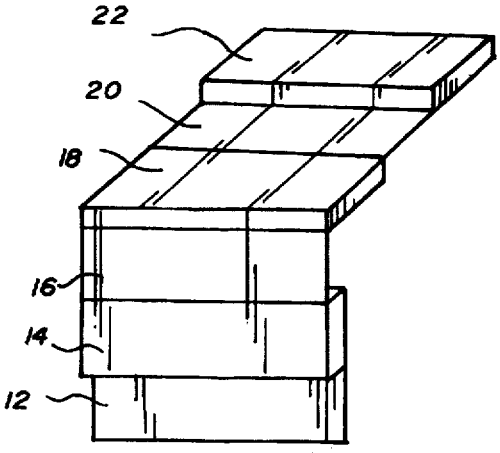

In FIG. 10, it will be seen that panels 12, 14, 16 and 18 are arranged as in FIG. 1. However, panel 20 has been folded to form a horizontal continuation of panel 18. Similarly, panel 22 is folded to form a horizontal continuation of panel 20. Insert panels 40 may be provided to overlie both panels 18 and 20 to provide continuous flush horizontal surfaces as necessary or desired. In FIG. 11, the first three panels 12, 14 and 16 may be folded to lie in generally coplanar vertical configuration, while the panels 18, 20 and 22 are folded to lie in a generally horizontal configuration. Insert panels 40 may be deployed to overlie panels 20 and 18 to form a flush horizontal surface with the surface of panel 22. Additionally, an insert panel 40 may be supplied to overlie panel 12 to provide a flush vertical surface, if necessary or desirable.

Figure 12:
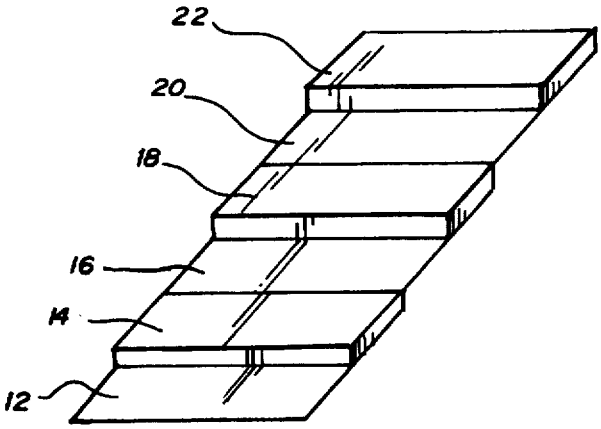

In FIG. 12, all of the panels may be arranged in a horizontal configuration. Insert panels 40 may be deployed, for example, to overlie each of panels 18 and 20. Two insert panels may be deployed to overlie each of panels 14 and 16 and three insert panels may be deployed to overlie panel 12. In this manner, a continuous horizontal surface may be provided. Various other positions using the basic six-panel configuration may be provided by folding the panels variously about the axes A—A, etc., and using insert panels as necessary or desirable. The leg lengths are adjusted for the different elevations of these various table configurations Referring now to FIG. 13, there is illustrated an alternative form of the multi-configuration table of the present invention. In this form, each of the step panels **14*a*, 18*a* and 22*a* are constructed similarly as described previously in connection with FIG. 1. The riser panels 12*a*, 16*a* and 20*a*, instead of having a flat, generally planar configuration, have a depth dimension and are similarly configured as the step panels 14*a*, 18*a* and 22*a*. Thus, each riser panel 12*a*, 16*a* and 20*a* is provided with legs, either pivotally mounted or otherwise, which are foldable between stored and extended positions, similarly as the step panels of FIG. 1**.

Figure 13:
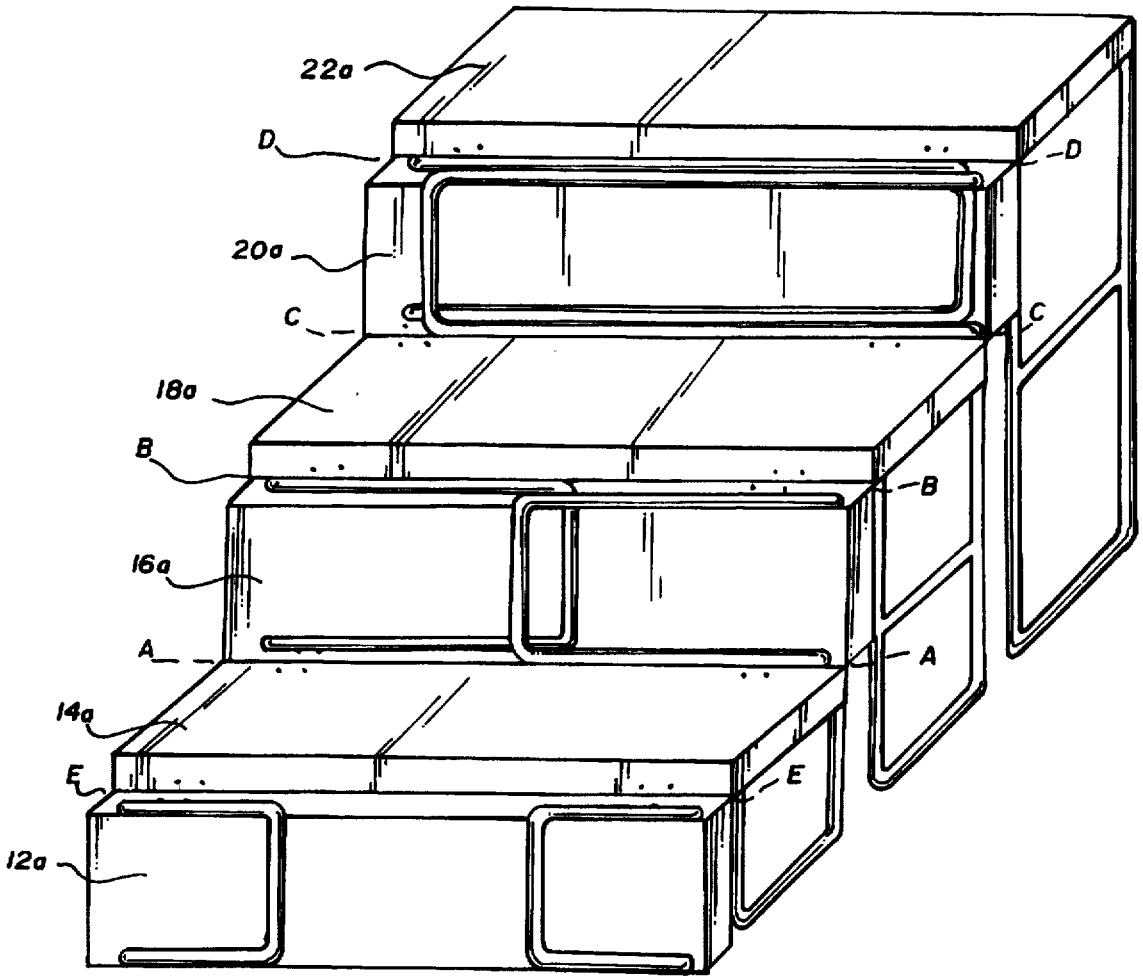
FIG. 13 is a perspective view similar to FIG. 1 of a further embodiment of the table according to the present invention.
Figure 14:
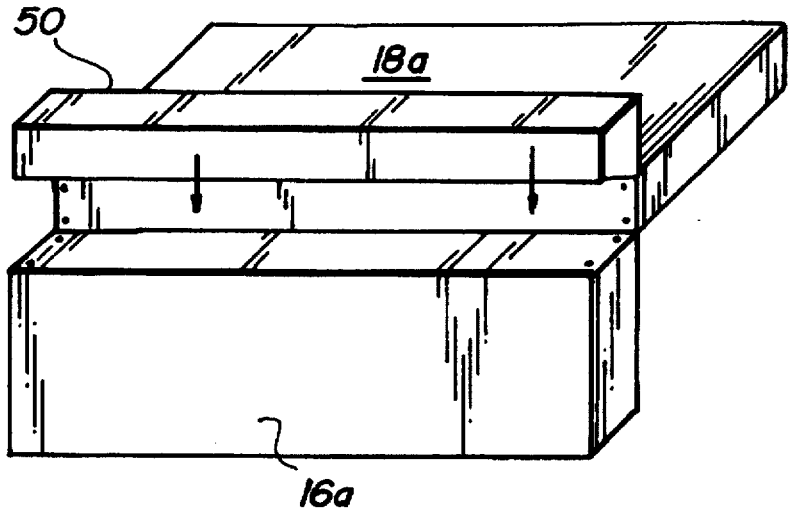
FIG. 14 is a schematic perspective view illustrating the use of an auxiliary insert panel for the table configuration of FIG. 13.

It will be appreciated that by providing a similar thickness to the riser panels as provided the step panels, the multi-tiered configuration illustrated in FIG. 13 has a rectilinear recess formed at the juncture of each of the adjacent riser and step panels and along their outside corners. Where necessary and desirable, insert panels 50, for example, as illustrated in FIG. 14 may be disposed in those recesses such that the vertical surfaces may lie flush with one another and the horizontal surfaces of the insert 50 and step panels may lie flush with one another. The insert panels illustrated in FIG. 14 may be pinned to the panels similarly as described previously.

Figure 15:
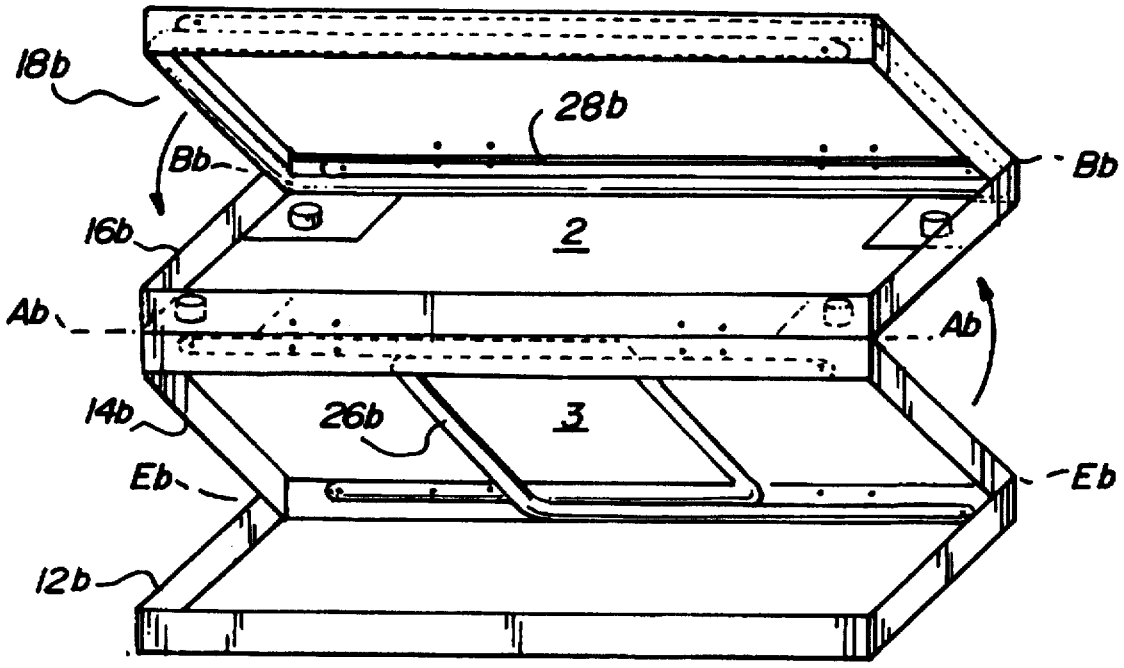
FIG. 15 is a schematic perspective view of a further embodiment of the present invention illustrating a table having nesting panels and risers.

Referring to the embodiment hereof illustrated in FIG. 15 wherein like parts as in the previous embodiments are designated by like reference numerals followed by the suffix "b," there is provided a nested table configuration with two step panels **14*b* and 18*b* and two riser panels 12*b* and 16*b*, although additional panels and risers may be provided as desirable. In the illustrated form, the step panels 14*b* and 18*b* are slightly smaller in length, width and depth dimensions than the riser panels 12*b* and 16*b*. Thus, step panels 14*b* and 18*b* are pivotal about axes Eb—Eb and Bb—Bb, respectively, into folded positions lying wholly within the riser panels 12*b* and 16*b*. Alternatively, the riser panels may be dimensionally smaller in length, width and depth than the step panels such that the step panels may receive the riser panels in a nesting relationship. It will be appreciated that the legs 26*b* and 28*b* are pivotal between their respective retracted or folded positions as illustrated within the peripheral and depth confines of the respective panels and extended table or panel support positions similarly as in the previous embodiments. Friction lock support braces similar to brackets 34 may be used, or the legs may be detachable from the panels for storage within the panels, or carried separately, enabling the table to be folded between its compact portable configuration and a table supported position. Legs may also be provided the risers 12*b* and 16*b*. Such legs may be positioned within the peripheral confines of the risers and nest within or lie in side-by-side relation to the respective legs 26*b* and 28*b* of the panels 14*b* and 18*b* or may be carried separately. In this manner, table configurations such as those illustrated in FIGS. 8–12** may be provided using this nested configuration, depending upon the number of riser and step panels used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi-tiered folding table, comprising:

a first generally planar panel;

a second planar panel pivotally secured along one side thereof to a side of said first panel for pivotal movement about a first axis in one direction between a first position extending generally normal to said first panel and a second folded position lying in a plane generally parallel to a plane containing said first panel;

a third planar panel pivotally secured along one side thereof to a side of said second panel opposite to and remote from said first panel for pivotal movement about a second axis generally parallel to said first axis and in a direction opposite said one direction between a first position extending generally normal to said second panel and a second folded position lying in a plane generally parallel to a plane containing said second panel;

said first panel having legs disposable in stored and supporting positions, said legs in said stored position extending generally parallel to said first panel and in said first panel supporting position extending from said first panel for supporting said first panel in a generally horizontal plane at a first elevation;

said third panel having legs disposed in stored and supporting positions, said legs of said third panel in said stored position extending generally parallel to said third panel and in said third panel supporting position extending from said third panel for supporting said third panel in a generally horizontal plane at a second elevation different from said first elevation, said second panel in said first position, when said legs of said first and third panels lie in said first and third panel supporting positions, extending between and lying generally perpendicular to said first and third panels;

said second and third panels being pivotal about said first and second axes, respectively, such that said first, second and third panels lie in generally parallel planes forming a compact portable folded multi-tiered table;

each said first and third panels having a pair of legs pivotally connected thereto at respective opposite ends of said first and third panels for pivotal movement about axes extending generally normal to said first and second axes;

each said first and third panels being generally rectilinear and having marginal flanges projecting therefrom about its perimeter, said legs of said first and third panels, when in said stored positions, lying within the peripheral confines of the respective panels and flanges, enabling the first, second and third panels to lie in generally parallel planes relative to one another when said legs lie in said stored positions, said legs of said third panel being longer than said legs of said first panel for supporting said third panel at said second elevation above said first elevation.

2. A table according to claim 1 wherein said second panel in said second folded position thereof overlies said first panel and said third panel in said second folded position thereof overlies said second panel whereby said first, second and third panels overlie one another in generally parallel planes when said second panel and said third panel are pivoted into respective second folded positions.

3. A table according to claim 1 wherein at least one of said first, second and third panels is dimensioned to enable nesting of said one panel within an adjacent panel when said one panel and said adjacent panel are pivoted to form said compact portable multi-tiered table.

4. A table according to claim 1 wherein an adjoining pair of first, second and third panels are pivotally secured to one another enabling the panels to lie in a common plane at an angle of 180° relative to one another.

5. A table according to claim 1 including a fourth planar panel pivotally secured along a side thereof to a side of said third panel opposite to and remote from said second panel for pivotal movement about a third axis in said one direction between a first position extending generally normal to said third panel and a second folded position generally parallel to a plane containing said third panel, and a fifth planar panel pivotally secured along a side thereof to a side of said fourth panel opposite to and remote from said third panel for pivotal movement about a fourth axis in said opposite direction between a first position extending generally normal to said fourth panel and a second folded position generally parallel to a plane containing said fourth panel, said fifth panel having legs disposable in stored and supporting positions, said legs of said fifth panel in said stored position extending generally parallel to said fifth panel and in said fifth panel supporting position extending from said fifth panel for supporting said fifth panel in a generally horizontal plane at a third elevation different from said first and second elevations, said fourth panel, when said legs of said third and fifth panels lie in said third and fifth panel supporting positions extending between and lying generally perpendicular to said third and fifth panels, said fourth and fifth panels being pivotal about said third and fourth axes, respectively, such that said fourth and fifth panels overlie one another and said first, second and third panels in generally parallel planes to form said compact folding multi-tiered table.

6. A table according to claim 5 wherein said fourth panel is pivotally secured to said third panel for pivotal movement about said third axis in said opposite direction between said first position thereof and a third position extending generally in a plane common to a plane containing said third panel when said third panel lies in said horizontal plane in said second elevation, said fifth panel being pivotally secured to said fourth panel for pivotal movement about said fourth axis to lie in said common plane with said fourth panel, whereby said third, fourth and fifth panels form a generally horizontal surface, the legs of said fifth panel being adjustable in length to support said fifth panel at an elevation corresponding to said second elevation.

7. A multi-tiered folding table comprising:

a plurality of generally planar panels pivotally secured to one another along opposite edges and in series with one another to define a plurality of spaced, generally parallel pivotal axes;

at least two of said panels having legs disposable in stored and supporting positions, respective legs of said two panels in said stored position extending generally parallel to said panels and in said supporting position extending therefrom for supporting the panels in generally horizontal planes, said legs of said two panels being different in length to support said two panels at different elevations relative to one another;

at least an intermediate panel of said plurality thereof being disposed between said at least two panels and extending generally normal to said two panels, said two panels with said legs in said stored position and said intermediate panel being pivotal about said axes, respectively, such that said at least two panels and said intermediate panel lie in planes generally parallel to one another forming a compact portable folded multi-tiered table;

each of said at least two panels having a pair of legs pivotally connected thereto at respective opposite ends thereof for pivotal movement about axes extending generally normal to said pivotal axes of said two panels;

each said two panels being generally rectilinear and having marginal flanges projecting therefrom about its perimeter, said legs of said two panels, when in said stored positions, lying within the peripheral confines of the respective panels and flanges, enabling the two panels and said intermediate panel to lie in generally parallel planes relative to one another when said legs lie in said stored positions and said panels are pivoted to form the compact portable folded multi-tiered table.

8. A table according to claim 7 wherein another panel of said plurality of panels is pivotally secured to an adjacent panel to lie in a common plane with said adjacent panel at an angle of 180° relative to one another and pivotal to a position overlying said adjacent panel.

9. A table according to claim 7 wherein at least one of said two panels and said intermediate panel is dimensioned to enable nesting of said one of said two panels and said intermediate panel within another of said two panels and said intermediate panel when said panels lie in said planes generally parallel to one another forming the compact portable folded multi-tiered table.

10. A table according to claim 7 wherein said panels are generally rectilinear having length, width and thickness dimensions, said panels having substantially identical widths thereby forming, when in their overlying positions, a compact portable folded multi-tiered table.

* * * * *